United States Patent [19]

Blank, Jr.

[11] 4,416,252

[45] Nov. 22, 1983

[54] APPARATUS FOR REMOVING AND TRANSPORTING ASHES

[76] Inventor: Charles J. Blank, Jr., c/o 311 Wonderly Ave., Dayton, Ohio 45419

[21] Appl. No.: 352,625

[22] Filed: Feb. 26, 1982

[51] Int. Cl.[3] ..... F23J 1/00; A01B 1/02; B65B 1/04

[52] U.S. Cl. ..... 126/242; 294/55; 141/350; 110/165 R

[58] Field of Search ..... 126/242, 243; 110/165 R, 165 A, 167, 169, 170; 141/108, 109, 350, 364, 319, 320, 321; 137/614.05; 294/55

[56] References Cited

U.S. PATENT DOCUMENTS

| | | | |
|---|---|---|---|
| 744,338 | 11/1903 | Hall | 141/108 |
| 1,474,634 | 11/1923 | Johanns | 294/55 |
| 1,757,740 | 5/1930 | Rosner | 220/335 |
| 1,762,347 | 6/1930 | Peebles | 294/55 |
| 2,344,507 | 3/1944 | Gookin | 221/11 |
| 4,032,037 | 6/1977 | Dubery et al. | 220/335 |
| 4,214,784 | 7/1980 | Rogalski | 294/55 |

FOREIGN PATENT DOCUMENTS

| | | | |
|---|---|---|---|
| 690089 | 3/1949 | Denmark | 126/243 |
| 157012 | 6/1904 | Fed. Rep. of Germany | 126/242 |
| 563649 | 11/1932 | Fed. Rep. of Germany | 126/243 |
| 678659 | 6/1939 | Fed. Rep. of Germany | 126/242 |
| 1931150 | 1/1971 | Fed. Rep. of Germany | 126/243 |

*Primary Examiner*—Samuel Scott
*Assistant Examiner*—G. Anderson
*Attorney, Agent, or Firm*—Biebel, French & Nauman

[57] ABSTRACT

An apparatus for removing and transporting ashes includes a scoop member having a hollow body, a forward end defining an ash receiving opening, and a scoop lid mounted to the body to rotate outwardly therefrom for alternating covering and uncovering the opening; and a container member defining an ash storage compartment and including a lid member defining mouth shaped to receive the forward end of the scoop member and a flap mounted to the lid member to rotate into the compartment for alternately covering and uncovering the mouth. The scoop lid includes a hook member and the flap includes a loop member so that the hook member may engage the loop member to form a rotatable link between the scoop lid and flap such that, when the forward end is inserted into the mouth of the container member, the scoop lid and flap rotate to an open position, thereby uncovering the opening mouth to allow ashes in the scoop member to fall into the storage compartment.

11 Claims, 6 Drawing Figures

APPARATUS FOR REMOVING AND TRANSPORTING ASHES

BACKGROUND OF THE INVENTION

1. Field of the Invention

The present invention relates to ash removing apparatus, and more particularly, to apparatus for removing ashes and the like from a hearth and transporting them to a remote location for dumping.

2. Prior Art

There is a resurgence in the use of wood stoves and fireplaces for heating homes. In many instances, the wood stove or fireplace is located in a room in a home which also contains furnishings which may become soiled or damaged if brought into contact with the ash generated by the combustion of fuel in the fireplace or wood stove. Therefore, it is necessary to remove ashes and the like from these stoves or fireplaces without permitting ash to fall on the surroundings.

In those applications in which the stove or fireplace is used for heating, fuel is burned on a substantially continuous basis. Therefore, in these applications it is often necessary to remove ashes from the unit while combustion of fuel is taking place, resulting in the removal of hot embers along with the cooler ashes.

Examples of devices for removing ashes and the like from stoves and fireplaces are disclosed in U.S. Pat. Nos. 4,214,784; 1,762,347; and 1,474,634. Each patent discloses an ash remover comprising a container having a hinged lid and a carrying handle, and a second handle mounted to a rod which is attached to the hinged lid. Movement of the second handle causes the lid to open and close. The devices have substantially flat lower surfaces so that they may be slid across the floor of a hearth to scoop ashes into their openings.

However, each of the prior art devices has a relatively limited amount of space for holding ashes scooped from the hearth, and the efficiency of such devices in collecting ashes is reduced as the volume of ashes retained increases. Such a device must repeatedly be emptied in order to remove most of the ashes from a stove or fireplace. If such a device is emptied into an open ash can or pail in the same room as the stove or fireplace, ash dust will inevitably settle on the room furnishing. If such a device is emptied at a remote location, the device will have to be carried repeatedly to the remote location, entailing significant time and effort.

Accordingly, there is a need for ash removal apparatus in which a substantial volume of ashes may be held until the heated embers cool, and an ash remover in which leakage of ashes is held to a minimum.

SUMMARY OF THE INVENTION

The present invention provides an apparatus for removing and transporting ashes and the like from a hearth in which the amount of ash dust generated is held to a minimum. In addition, the present invention provides an ash removing apparatus which provides an ash storage container for holding the ashes until hot embers contained within the volume of ashes are cooled and the ashes are safe to be thrown out. Furthermore, the invention provides an apparatus for removing and transporting ashes which is relatively simple in construction and which does not require expensive fabrication operations or expensive materials.

The present invention includes a scoop member having a hollow body, a rearward tubular end sized to be grasped by the user, a forward end which defines an ash receiving opening, and a scoop lid which is rotatably mounted to the body to open and close the opening. The invention also includes a container member which defines an ash storage compartment and includes a lid member which defines a mouth shaped to receive the forward end of the scoop member. The container member also includes a flap which is rotatably mounted to the lid member so that it rotates into the compartment for alternately covering and uncovering the mouth. The scoop member includes a hook mounted to its outer surface, and the flap includes a loop mounted to its outer surface which is sized to receive the hook to form a rotatable link or hinge between the scoop lid and flap.

The apparatus is used by rotating the scoop lid to uncover the ash receiving opening of the scoop member, then sliding the scoop member along the floor of the hearth so that ashes lying on the floor are scooped into the hollow body of the scoop member. The scoop member is removed from the hearth and the scoop lid is closed to seal the ashes and hot embers within the hollow body, thereby minimizing the spillage of ashes from the scoop member.

The scoop member is then placed above the mouth of the container member and the hook is fitted into the loop on the flap. The forward end of the scoop member is inserted into the mouth and the displacement of the forward end causes the scoop lid and flap, now rotatably linked to each other, to rotate to an open position, thereby permitting the contents of the scoop member to be discharged into the container member. Since the container member does not have openings other than the mouth in which the scoop member is inserted, the dust generated by the passage of ashes from the scoop member to the container member is retained within the container member and cannot be deposited on the surroundings.

After the ashes have been discharged from the scoop member into the container member, upward displacement of the scoop member causes the flap and scoop lid to be rotated to a closed position. The hook can then be disengaged from the loop, sealing the ashes within the container.

In a preferred embodiment, the lid member includes a groove extending about the mouth adjacent the flap, and the flap includes a raised ridge which extends about its periphery and is shaped and positioned to matingly engage the groove. The flap is mounted to the lid by a spring-loaded hinge so that it is biased upwardly against the lid and the ridge engages the groove to provide a seal.

The scoop member includes a flange about its periphery and spaced rearwardly from the ash receiving opening of the forward end. The flange provides a stop which limits the length of the forward end which can be inserted into the mouth of the container member. In addition, when the scoop member is inserted into the container member, a reciprocating motion of the scoop member which brings the flange in repeated contact with the lid member, helps to jar loose ashes which may cling to the interior of the hollow body.

Accordingly, it is an object of the present invention to provide an apparatus for removing and transporting ashes and the like from a hearth which minimizes the spillage of ashes to the area surrounding the hearth; to provide an apparatus in which ashes containing members can be held safely until the embers cool and the ashes can be safely thrown out; and an apparatus which is relatively simple to fabricate and does not require expensive materials.

Other objects and advantages of the invention will be apparent from the following description, the accompanying drawings and the appended claims.

DETAILED DESCRIPTION OF THE PREFERRED EMBODIMENT

Figure 1:
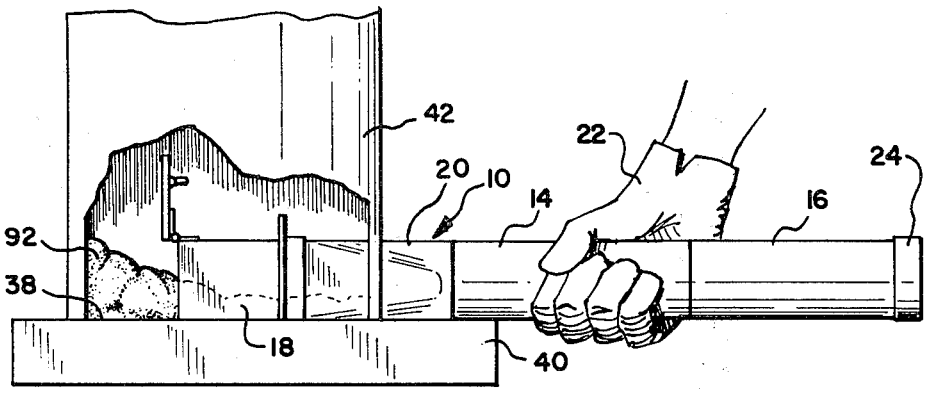
FIG. 1 is a side elevation of the scoop member of the preferred embodiment inserted into the hearth of a stove, the wall of the stove being broken away to show its interior.
Figure 2:
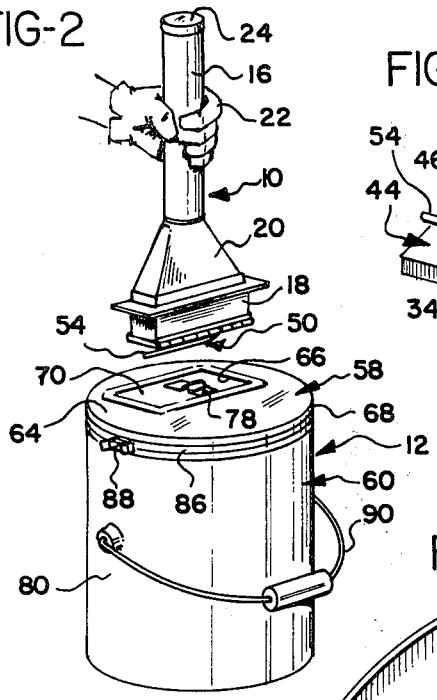
FIG. 2 is a perspective view of the scoop member and container member of the preferred embodiment.

As shown in FIGS. 1 and 2, the apparatus for removing and transporting ashes and the like includes a scoop member 10 and a container member 12. The scoop member 10 includes a hollow body 14 having a tubular rearward portion 16 and a forward end 18. The forward end 18 is substantially rectangular in shape and includes a transition section 20 which joins the forward end to the rearward portion 16. The rearward portion 16 is sized to be grasped by the hand 22 of a user and includes an end cap 24 which seals the end of the rearward portion.

Figure 3:
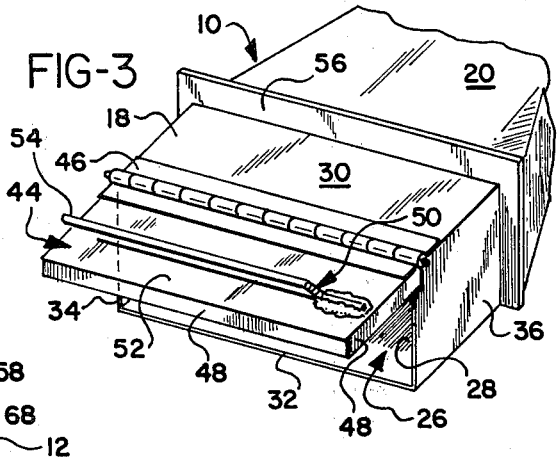
FIG. 3 is a perspective view of the forward end of the scoop member of FIG. 2.
Figure 4:
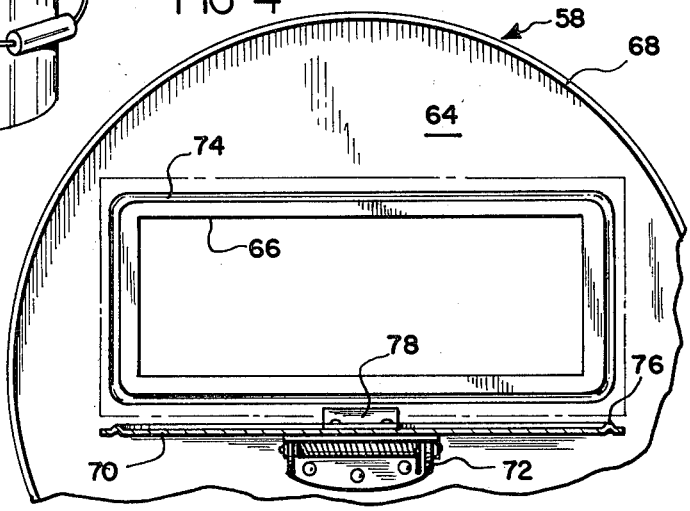
FIG. 4 is a detail of the underside of the lid member of the container member showing the flap rotated to an open position, and in which the flap is in section.

As shown in FIGS. 2 and 3, the forward end 18 of the scoop member 10 defines an ash receiving opening 26 which provides the only opening to the interior portion 28 of the hollow body 14. The ash receiving opening 26 is defined by top and bottom walls 30, 32 and side walls 34, 36. The bottom wall 32 of the forward end 18 preferably is planar in shape so that the scoop member 10 may be slid along the floor 38 of a hearth 40 of a wood stove or fireplace 42 (FIG. 1).

The scoop member 10 also includes a scoop lid 44 which is attached to the top wall 30 by a piano hinge 46. The scoop lid 44 includes a rim 48 which extends about its periphery. The rim 48 is sized to engage the walls 30, 32, 34, 36 of the forward end 18 in an interference fit so that, when rotated to close the opening 26, the lid will remain in the closed position. Other means, obvious to one having skill in the art, may be employed to secure the lid 44 in a closed position, such as magnets or mating detents formed on the rim 48 and forward end 18, and remain within the scope of the invention.

A hook member 50 is mounted to an exterior surface 52 of the scoop lid 44 by means such as welding. The hook member includes an offset portion 54 which is spaced from the exterior surface 52.

A flange 56 is mounted to the forward end 18 and extends about the periphery of side walls 34, 36 and top wall 30. The flange 56 is positioned rearwardly of the opening 26. The flange 56 does not extend across the bottom wall 32 so that the scoop member 10 may be slid across the hearth floor 38 while oriented substantially parallel to the floor.

As shown in FIGS. 2, 4, 5, and 6, the container member 12 includes a lid member 58, and a lower portion 60. The lid member 58 and lower portion 60 define an ash storage compartment 62 within the interior of container member 12. The lid member 58 has an upper surface 64 which defines a mouth 66 and includes a lip 68 extending about the outer periphery of the upper surface.

A flap 70 is generally rectangular in shape and is mounted adjacent the mouth 66. A flap 70 is mounted to the underside of the upper surface 64 by a spring-loaded hinge 72 and is positioned adjacent the mouth 66. The flap 70 is generally rectangular in shape and is sized to cover the mouth 66 completely.

The upper surface 64 of the lid member 58 includes a groove 74 which extends about the mouth 66. The flap 70 includes a raised ridge 76 which extends about is perimeter. The ridge 76 is shaped and sized to matingly engage the groove 74 when the flap 70 is rotated to close the mouth 66.

A loop member 78 is mounted to the upper surface of the flap 70. The loop member defines an opening sized to receive the offset portion 54 of the hook member 50.

The lower portion 60 of the container member 12 includes an upright wall 80 having an upper edge 82 which defines an open end 84 of the lower portion. The lid member 58 is attached to the lower portion 60 by placing the lid member over the open end 84 so that the lip 68 engages the wall 80 adjacent the upper edge 82 in an interference fit. To prevent the lid member 58 from separating from the lower portion 60 during use, tightening means such as a split band 86 having an overcenter locking mechanism 88 of well-known design may be employed. The band 86 preferably is placed about the periphery of the lip 68 so that, when tightened, it urges the lip 68 against the upper edge 82 of the wall 80. The lower portion 60 preferably includes a carrying handle 90 which is rotatably attached to the upright wall 80.

The operation of the ash removing apparatus is as follows. As shown in FIG. 1, the scoop lid 44 is rotated to an open position in which the ash receiving opening 26 of the forward end 18 is uncovered. The rearward portion 16 of the scoop member 10 is grasped by the hand 22 of the user and the forward end 18 is inserted into the stove 42 by sliding the forward end along the floor 38 of the hearth 40. The sliding motion of the scoop member 10 causes ashes 92 and hot embers, if any, to enter the interior portion 28 of the scoop member.

After the ashes 92 have entered the interior portion 28, the scoop member 10 is withdrawn from the stove 42. The scoop lid 44 is rotated to a closed position so that the rim 48 engages the side walls 34, 36 and bottom wall 32 of the forward end.

As shown in FIG. 3, the scoop member 10 is then positioned substantially vertically above the container member 12 so that the scoop lid 44 is in registry with the mouth 66 of the lid member 58. The interference fit between the rim 48 and the walls and bottom of the forward end 18 prevent the scoop lid 44 from opening while the scoop member 10 is held in this position.

Figure 5:
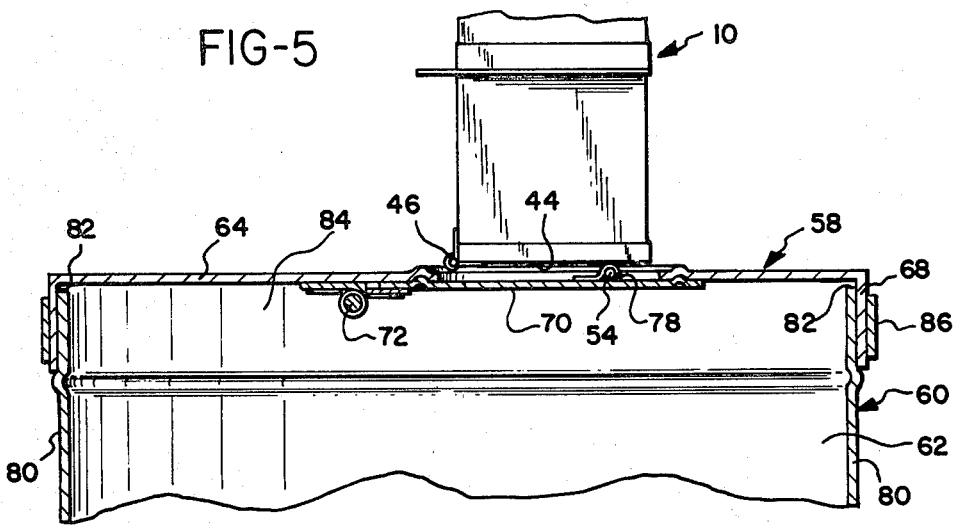
FIG. 5 is a detail of the scoop member and container member in which the hook of the scoop member is linked to the loop of the container member and the container member is in section.

As shown in FIG. 5, the scoop member 10 is moved to one side and the offset portion 54 of the hook member 50 is inserted into the opening of the loop member 78. The hook member 50, and the remainder of the scoop member 10, is displaced until the scoop lid 44 is again in registry with the mouth 66.

Figure 6:
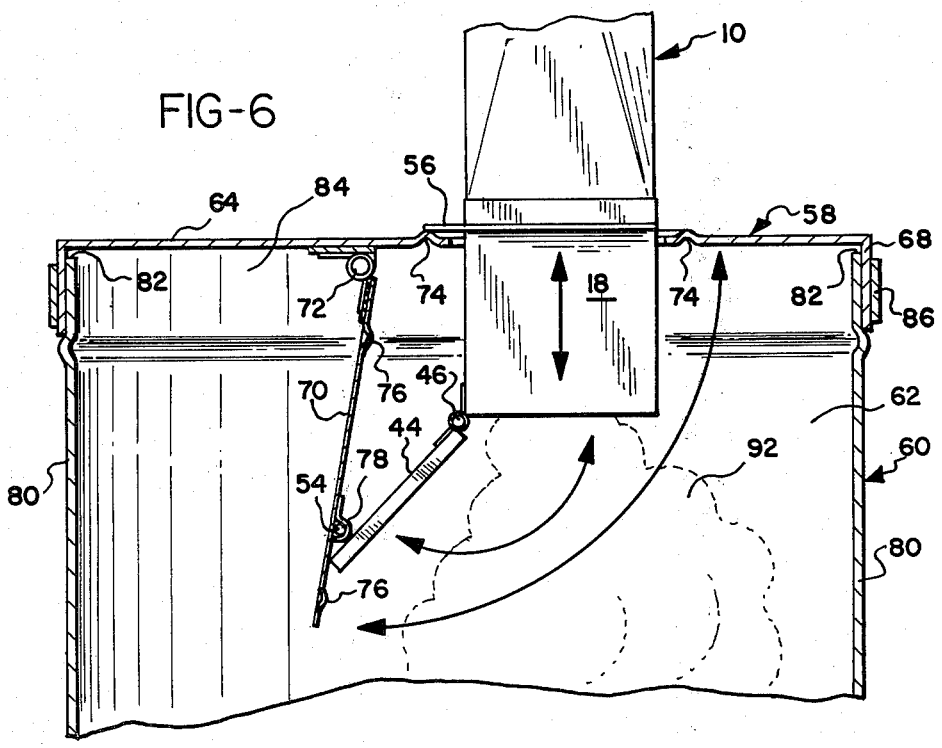
FIG. 6 is a detail of the scoop member and container member of FIG. 5 in which the scoop member has been inserted into the container member and the container member is in section.

As shown in FIG. 6, the scoop member 10 is then displaced downwardly until the flange 56 abuts the upper surface 64 of the lid member 58. As shown in the Figure, the flange 56 abuts the corresponding raised portion caused by forming the groove 74 in the underside of the lid member 58. As the scoop member 10 is displaced downwardly, the offset portion 54 rotates relative to the loop member 78 and the hook and loop members (50, 78) act as a hinge between the lid 44 and flap 70. At the same time, the downward movement of the scoop member 10 causes the scoop lid 44 and flap 70 to rotate about their respective hinges 46, 72 to an open position, thereby permitting the ashes 92 and other debris collected within the scoop member to be discharged into the ash storage compartment 62 of the lower portion 60.

The downward movement of the scoop member 10 causes the scoop lid 44 and flap 70 to rotate into their respective open positions because the downward movement of the scoop member causes the hinge 46 to abut the upper surface of the flap 70 at first, then casuses the flap to pivot about the hinge (46) so that the hinge act as a fulcrum. As the flap 70 pivots about the hinge 46, the scoop lid 44, which is attached to the flap, is rotated with the flap. Further downward movement of the scoop member 10 causes the axis of rotation of the scoop lid 44, which is defined by the hinge 46, to move downwardly, which causes both the lid and the flap 70 to rotate further.

When the scoop member 10 is withdrawn from the mouth 66 of the lid member 58, the scoop lid 44 and flap 70 rotate in a reverse direction until the scoop member is fully withdrawn from the ash storage compartment 62. At this position, the flap 70 completely closes the mouth 66 and the raised ridge 76 engages the groove 74 to seal the contents of the container member 12.

While the scoop member 10 is positioned with respect to the container member 12 as shown in FIG. 6, ashes and other material which may cling to the interior portion of the scoop member may be dislodged by repeatedly raising and lowering the scoop member so that the flange 56 repeatedly hits against the upper surface 64 of the lid member 58. Since the forward end 18 of the scoop member 10 substantially completely fills the mouth 66, the dust generated by this movement will not leave the interior storage compartment 62 of the container member 12. Once the scoop member has been removed from the container member 12 and the hook 50 disengaged from the loop member 78, the container member 12 can be transported to a remote location for dumping.

The scoop member 10 and container member 12 preferably are made of sheet metal or other metal which can withstand the raised temperatures encountered in the removal of heated embers and ashes from a stove. Furthermore, it is desirable to utilize a metallic container member to hold the heated embers and ashes until they have cooled sufficiently to be disposed of safely.

Variations and modifications may be made in the shape of the scoop member 10 and container member 12 and not reduce the ash dust confining capabilities of the invention. For example, the scoop member 10 could be modified so that the rearward tubular end 16, which provides additional ash storage capacity, is replaced by a rod extending from the rear of the forward end 18, thus eliminating the need for transition member 20. The rod preferably would be covered by a grip similar to a bicycle grip.

Accordingly, while the form of apparatus herein described constitutes a preferred embodiment of this invention, it is to be understood that the invention is not limited to this precise form of apparatus, and that changes may be made therein without departing from the scope of the invention.

What is claimed is:

1. An apparatus for removing and transporting ashes and the like from a hearth, comprising;

a scoop member having a hollow body, said body having a forward end defining an ash receiving opening, and a scoop lid mounted to said body to rotate outwardly therefrom for alternately covering and uncovering said opening;

a container member defining an ash storage compartment and including a lid member defining a mouth shaped to receive said forward end and a flap mounted to said lid member to rotate into said compartment for alternately covering and uncovering said mouth; and means attached to said scoop lid and said flap for linking said scoop lid to said flap such that insertion of said forward end into said mouth when said scoop lid and said flap are linked causes said scoop lid and said flap to rotate, thereby uncovering said opening and said mouth so that ashes contained within said body may pass to said storage compartment.

2. The apparatus of claim 1 wherein said forward end of said scoop member includes a substantially flat surface adjacent said opening for engaging a hearth.

3. The apparatus of claim 2 wherein said forward end of said scoop member includes a flange extending about a periphery of said forward end exclusive of said flat surface and positioned rearwardly of said opening, said flange projecting outwardly from said forward end such that said flange cannot enter said mouth.

4. The apparatus of claim 3 wherein said hollow body includes a rearward portion which is tubular in shape and sized to be grasped by the hand of a user.

5. The apparatus of claims 1 or 4 wherein said lid member of said container member includes a groove extending about said mouth adjacent said flap, and said flap includes a raised ridge extending about its periphery, said ridge sized and positioned to matingly engage said groove such that a seal is formed when said flap covers said mouth.

6. The apparatus of claim 5 further comprising a spring-loaded hinge mounting said flap to said lid member, said hinge urging said flap against said lid member.

7. The apparatus of claim 6 wherein said container member includes a lower portion having an upright wall, said wall having an upper edge defining an open end of said lower portion; and said lid member includes a downturned lip extending about its periphery, said downturned lip having a size and shape such that said lip engages said wall adjacent said upper edge in an interference fit, and said lid member covers said open end.

8. The apparatus of claim 7 wherein said container member includes split band means extending about said lip, said band means having overcenter tightening means for alternately tightening and loosening said band means about said lip.

9. The apparatus of claim 8 wherein said linking means comprises a hook member mounted to said scoop lid and a loop member mounted to said flap, said hook member sized to alternately engage and disengage said loop member.

10. The apparatus of claim 9 wherein said scoop lid includes means for holding said scoop lid in a closed position wherein said opening is covered.

11. The apparatus of claim 10 wherein said holding means comprises a rim extending about said scoop lid, said rim sized to engage said forward end adjacent said opening in an interference fit.

* * * * *